US005349765A

United States Patent [19]

Kitanaka et al.

[11] Patent Number: 5,349,765

[45] Date of Patent: Sep. 27, 1994

[54] EXCAVATOR FOR CONSTRUCTING UNDERGROUND CONTINUOUS WALL AND CONSTRUCTION METHOD USING THE EXCAVATOR

[75] Inventors: Katsumi Kitanaka; Takehiko Kitanaka, both of Tokyo, Japan

[73] Assignee: Hokushin Kogyo Corporation, Tokyo, Japan

[21] Appl. No.: 908,166

[22] Filed: Jul. 2, 1992

[30] Foreign Application Priority Data

Apr. 1, 1992 [JP] Japan ..... 4-079849

[51] Int. Cl.[5] ..... E02F 3/14; E02D 5/18

[52] U.S. Cl. ..... 37/356; 37/357; 37/464; 405/267

[58] Field of Search ..... 37/63, 69, 86–90, 37/191 R, 191 A, 322, 323, 329, 330, 331, 327, 355, 356, 357, 358, 359, 360, 361, 362, 462–465; 405/267, 269

[56] References Cited

U.S. PATENT DOCUMENTS

| | | | |
|---|---|---|---|
| 532,510 | 1/1895 | Wiggs | 299/83 |
| 1,777,439 | 10/1930 | Lamont | 37/86 |
| 3,893,302 | 7/1975 | Peterson | 37/86 X |
| 4,379,658 | 4/1983 | Schmednecht | 405/267 |
| 4,714,379 | 12/1987 | Gilchrist, Jr. | 405/267 X |
| 4,775,189 | 10/1988 | Den Besten . | |
| 4,843,742 | 7/1989 | Camelleri | 37/90 |
| 4,924,609 | 5/1990 | Martin | 37/191 A |
| 5,112,161 | 5/1992 | Trevisani | 37/192 A X |

FOREIGN PATENT DOCUMENTS

| | | | |
|---|---|---|---|
| 0249231 | 12/1987 | European Pat. Off. . | |
| 1634387 | 1/1970 | Fed. Rep. of Germany . | |
| 1458165 | 11/1966 | France | 405/267 |
| 60-159213 | 8/1985 | Japan . | |
| 604922 | 4/1978 | U.S.S.R. | 37/191 A |
| 1099699 | 1/1968 | United Kingdom . | |

*Primary Examiner*—Randolph A. Reese
*Assistant Examiner*—J. Russell McBee
*Attorney, Agent, or Firm*—Stevens, Davis, Miller & Mosher

[57] ABSTRACT

An excavator for constructing an underground continuous wall includes an extensible guide post, an endless chain extending around a chain driving wheel provided at the upper portion of the guide post and a chain sprocket at the lower portion of the guide post, and a number of cutter bits and a number of agitator bars alternately arranged on the chain to form an endless chain cutter and a jet pipe provided in the guide post to be connectable to a fluid supply source and having a number of nozzles branched from the jet pipe. The endless chain cutter is detachably fixed to the end of the boom extending from a vehicle traveling on the ground. The endless chain cutter may be vertically movably mounted on the boom so as to be vertically driven by a driving device. The cutter bits are changeable with harder cutter bits according to obstacles in the ground.

1 Claim, 13 Drawing Sheets

EXCAVATOR FOR CONSTRUCTING UNDERGROUND CONTINUOUS WALL AND CONSTRUCTION METHOD USING THE EXCAVATOR

BACKGROUND OF THE INVENTION

This invention relates to an excavator for excavating ground to construct an underground continuous wall and a construction method using the excavator in civil engineering and construction works.

In constructing such an underground continuous wall according to a prior art technique, first a hole of an elliptical section having a 2 to 3 m major axis is dug in the ground to a predetermined depth by a powerful bucket or a hole is dug to a predetermined depth by two or three series of auger drills. After the hole is formed slurry is sealed with a bentonite solution to prevent further penetration of slurry, a reinforcing bar cage is placed in the hole and a ready mixed-concrete is then poured into the hole to form a foundation column. Such a method is repeated to form an underground continuous wall.

With the underground continuous wall constructing method of the prior art described above, the processes are complicated and hence take much time for the completion of the continuous wall. Moreover, slurry or bentonite solution layers at joints between successive columns interrupts the formation of the continuous wall so that after completion of the wall, ground water tends to leak into the inside of the continuous wall through the joints. It is therefore very difficult to provide an underground continuous wall simultaneously having two functions, to serve as a foundations wall and a diaphragm wall.

Moreover, in order to improve the ground in connection with construction of the underground continuous wall in the past, there had been a ground improving method wherein the ground is excavated with earth augers or the like, and at the same time a stabilizer is forcedly mixed with the earth and sand by agitator blades or the like. However, the operations of the method cannot be continuously carried out but only intermittently performed and hence with inefficiency.

Furthermore, in constructing underground wall piles (referred to sometimes as "elliptical piles") having substantially rectangular cross-sections as seen in a plan view, in the past, rectangular holes were formed by excavating the ground by clam buckets or manually. However, such operations are inefficient and dangerous.

Moreover, in removing underground obstacles such as rocks, concrete blocks and the like in the past, rock augers or the like were used to crush them and thereafter they were removed. Such operations are inefficient because of involving extra processes using an additional apparatus other than that used in the construction method of the underground continuous wall.

SUMMARY OF THE INVENTION

It is, therefore, an object of the invention to provide an excavator for constructing the underground continuous wall in simple processes in a short construction period, which wall is substantially smoothly continuous to have two functions as a wall foundation and a diaphragm wall.

It is another object of the invention to provide construction methods for improving the ground, constructing wall piles and removing underground obstacles, which can be easily carried out with high efficiency without requiring any additional apparatus other than the excavator used for constructing an underground continuous wall.

In order to accomplish the first object, the excavator for constructing the underground continuous wall according to the invention comprises a boom extending from a vehicle traveling on the ground and having an end outwardly projecting from one side of the vehicle, an extensible guide post detachably fixed to the end of the boom, an endless chain extending around a chain driving wheel provided at the upper portion of the guide post and a chain sprocket at the lower portion of the guide post, a number of cutter bits and a number of agitator bars alternately arranged on the chain to form an endless chain cutter, and a jet pipe provided in the guide post so as to be connectable to a fluid supply source and having a number of nozzles branched from the jet pipe.

In constructing the underground continuous wall by the use of the excavator of the invention, first a vertical hole having a predetermined depth is dug in the ground at a position where the underground continuous wall is to be constructed. After the endless chain cutter having a desired length has been assembled in the hole, the chain cutter is fixed to the boom extending from the vehicle. While the chain cutter is driven, the vehicle is driven in one direction to excavate one side of the walls. Underground continuous walls are constructed in this manner. As the excavator is applied to a vehicles such as crawler type vehicle moving on the ground, it is possible to use the excavator at any places with ease for rapidly executing the operation.

In another aspect of the invention, the excavator for constructing an underground continuous wall comprises an extensible guide post provided on both its side surfaces with guide rails in longitudinal directions of the guide post. At least one rack is provided in parallel with the guide rails, an endless chain extends around a chain driving wheel provided at the upper portion of the guide post and a chain sprocket at the lower portion of the guide post. A number of cutter bits and a number of agitator bars are alternately arranged on the chain to form an endless chain cutter, a jet pipe is provided in the guide post so as to be connectable to a fluid supply source and having a number of nozzles branched from the jet pipe. Supporting plates are provided on one end of a boom extending from a vehicle traveling on the ground for vertically movably supporting the endless chain cutter on both its sides. A pinion is provided on the supporting plates so as to be in mesh with the rack, and driving means are provided for driving the pinion.

As the excavator of the second aspect of the invention enables the endless chain cutter to move upward and downward relative to the boom extending from the vehicle, the cutter can be set at a desired depth by driving the chain of the cutter to force it into the ground. Therefore, the excavator according to the second aspect of the invention needs no boring machine such as an earth drill which is required in the prior art.

In both the excavators according to the invention, the endless chain extends around the chain sprocket pivotally supported at the lower end of the guide post and the drive wheel provided at the upper end of the guide post, and a number of cutter bits and a number of agitator bars are alternately arranged on the chain to form the endless chain cutter. The endless chain of the cutter is adapted to be driven and the vehicle is made movable so that an underground continuous wall can be constructed with high accuracy and efficiency.

Moreover, in a method for constructing an underground continuous wall by using the excavator the second aspect, the method according to the invention comprises the steps of bringing the lower end of the endless chain cutter of the excavator into contact with the ground at a predetermined position, forcing the endless chain cutter into the ground to a desired depth by driving the pinion in mesh with the rack, while driving the endless chain, and excavating the ground in a predetermined direction by driving the vehicle, while jetting a hardening liquid such as a cement milk through the jet pipe provided in the guide post of the endless chain cutter, thereby mixing the hardening liquid with the earth and sand in the excavated hole to form a soil cement wall.

The method for constructing an underground continuous wall by using the excavator of the second aspect of the invention needs no extra boring machine digging a hole to a predetermined depth as in the prior art method. According to the method of the invention, moreover, the ground is continuously excavated by the excavator, while the underground continuous wall can be continuously constructed by soil cement or cement mortar in the space immediately after being excavated. As the underground continuous wall constructed by the method according to the invention have smooth surfaces without any joints or steps, there is no risk of ground water leaking through the wall. Therefore, the method according to the invention can construct the continuous wall in the ground and at the same time enables the built continuous wall to be used as foundation wall.

In a ground improving method using an endless chain cutter including an extensible guide post, an endless chain extending around a chain driving wheel provided at the upper portion of the guide post and a chain sprocket at the lower portion of the guide post, a number of cutter bits and a number of agitator bars alternately arranged on the chain, and a jet pipe provided in the guide post so as to be connectable to a fluid supply source and having a number of nozzles branched from the jet pipe, the method according to the invention comprises the steps of inserting the endless chain cutter into the ground, excavating the ground in a predetermined direction by the endless chain cutter, while jetting a highly pressurized fluid through the jet pipe therearound to destroy the stratum of the ground and adding a stabilizer thereto to stabilize the ground.

The ground improving method according to the invention is capable of continuously excavating the ground by use of the excavator described above and at the same time stabilizing strata thereat. Therefore, the method of the invention can always obtain uniformly stabilized ground. As the method needs no additional equipment, the stabilizing operation is executed with low cost and with high efficiency, In a pile wall constructing method using an endless chain cutter including an extensible guide post, an endless chain extending around a chain driving wheel provided at the upper portion of the guide post and a chain sprocket at the lower portion of the guide post, and a number of cutter bits and a number of agitator bars alternately arranged on the chain, the method according to the invention comprises the steps of inserting the endless chain cutter into the ground to a predetermined depth, excavating a hole, which is rectangular as seen in a plan view, by moving the endless chain cutter in a predetermined direction through a desired distance, while driving the endless chain, inserting reinforcing steel into the hole and placing concrete in the hole to form a wall pile.

The pile wall forming method according to the invention can easily construct a wall pile by using the excavator for constructing underground continuous walls without using clam buckets. Therefore, the forming operation can be executed with high efficiency without any danger as in the prior art.

Moreover, in an underground obstacle removing method using an endless chain cutter including an extensible guide post, an endless chain extending around a chain driving wheel provided at the upper portion of the guide post and a chain sprocket at the lower portion of the guide post, and a number of cemented carbide cutter bits arranged on the chain, the method according to the invention comprises the step of moving the endless chain cutter, while driving the chain of the endless chain cutter, thereby removing obstacles in the ground.

The underground obstacle removing method according to the invention needs no particular crushers such as rock augers as required in the prior art. All that is required is to replace usual cutter bits of the endless chain cutter of the excavator with harder cutter bits such as cemented carbide tip bits. With such an excavator, underground obstacles can be cut and removed, while a groove for the underground continuous wall is excavated without requiring any particular arrangement therefor. Consequently, the operation efficiency can be greatly improved.

The invention will be more fully understood by referring to the following detailed specification and claims taken in connection with the appended drawings.

DESCRIPTION OF THE PREFERRED EMBODIMENTS

Figure 1:
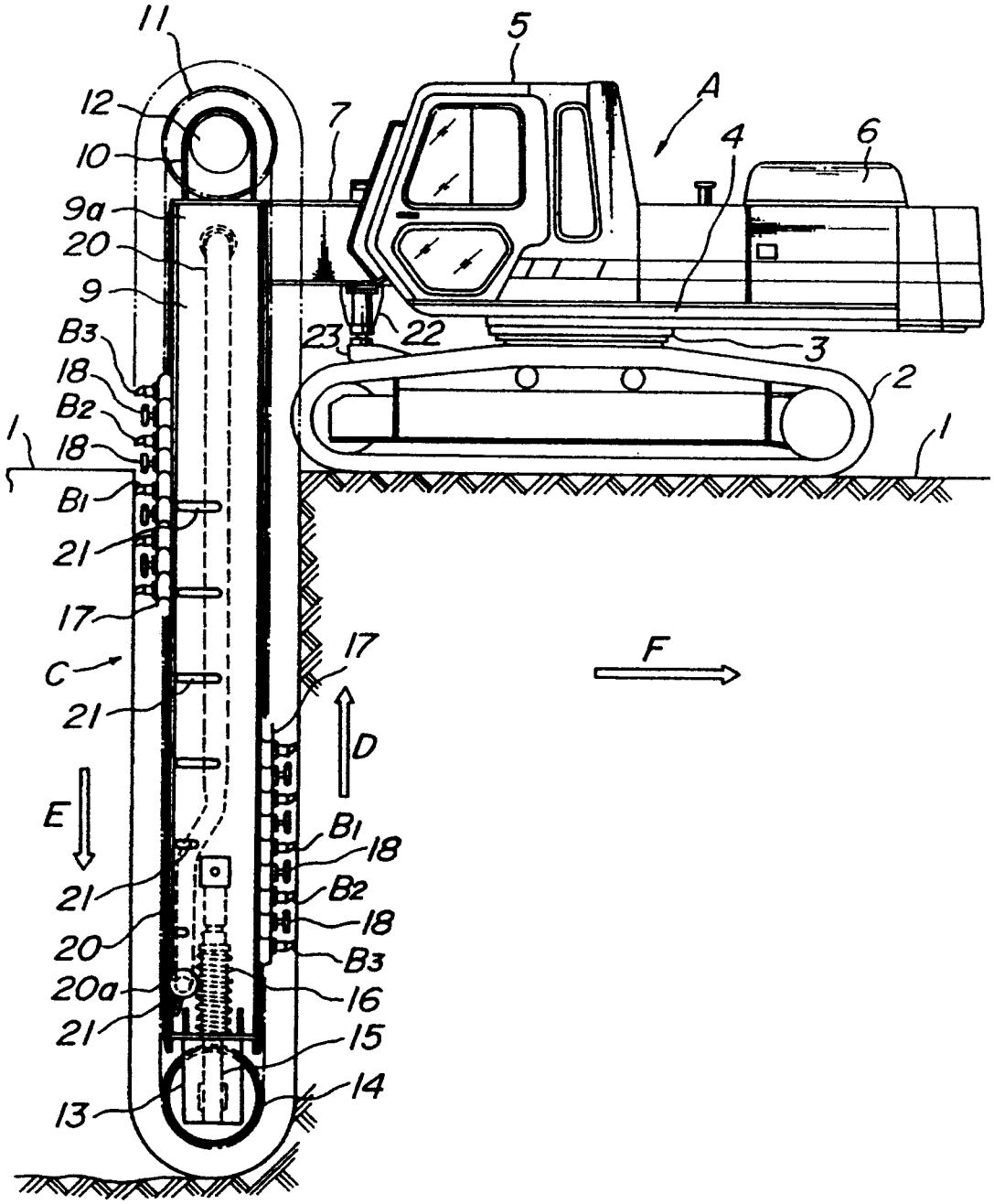
FIG. 1 is a side view of the excavator of the first embodiment according to the invention.
Figure 2:
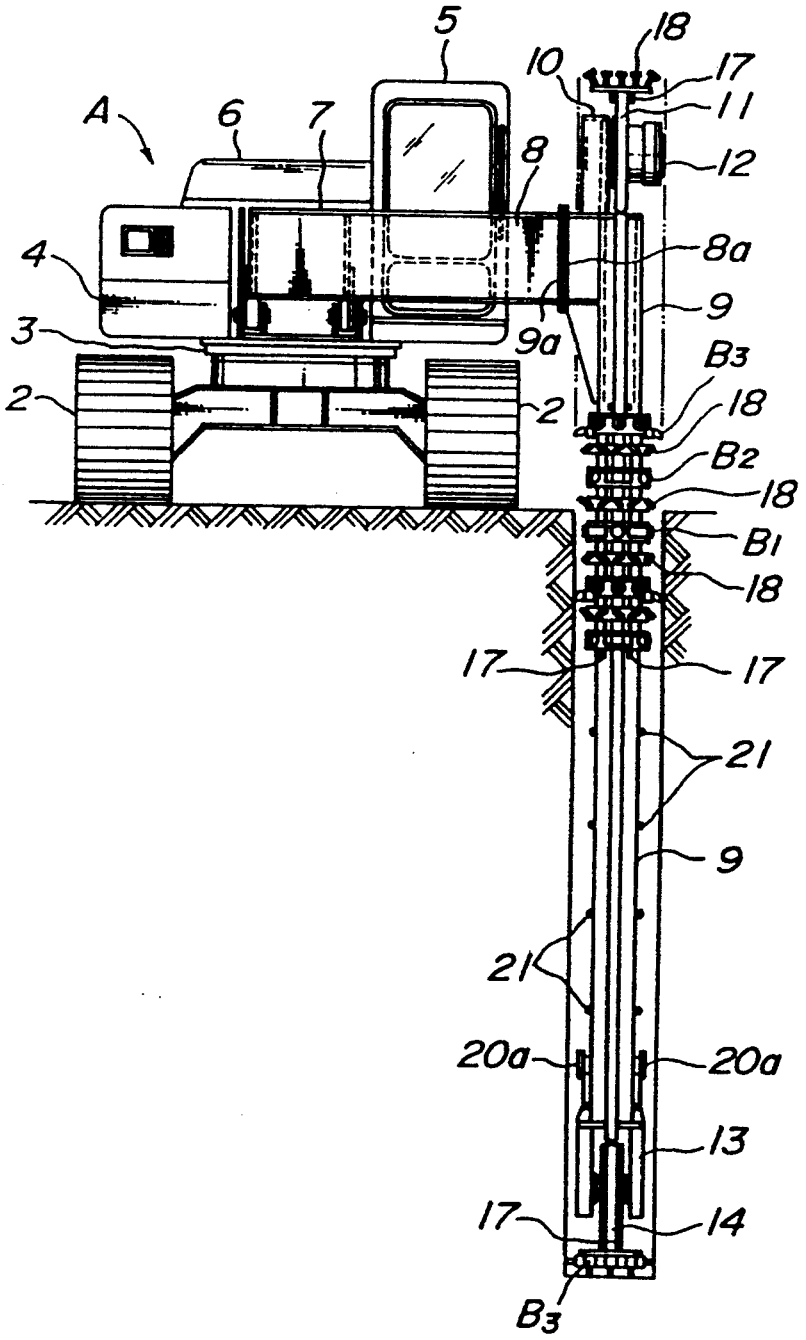
FIG. 2 is a front view of the excavator shown in FIG. 1.
Figure 3:
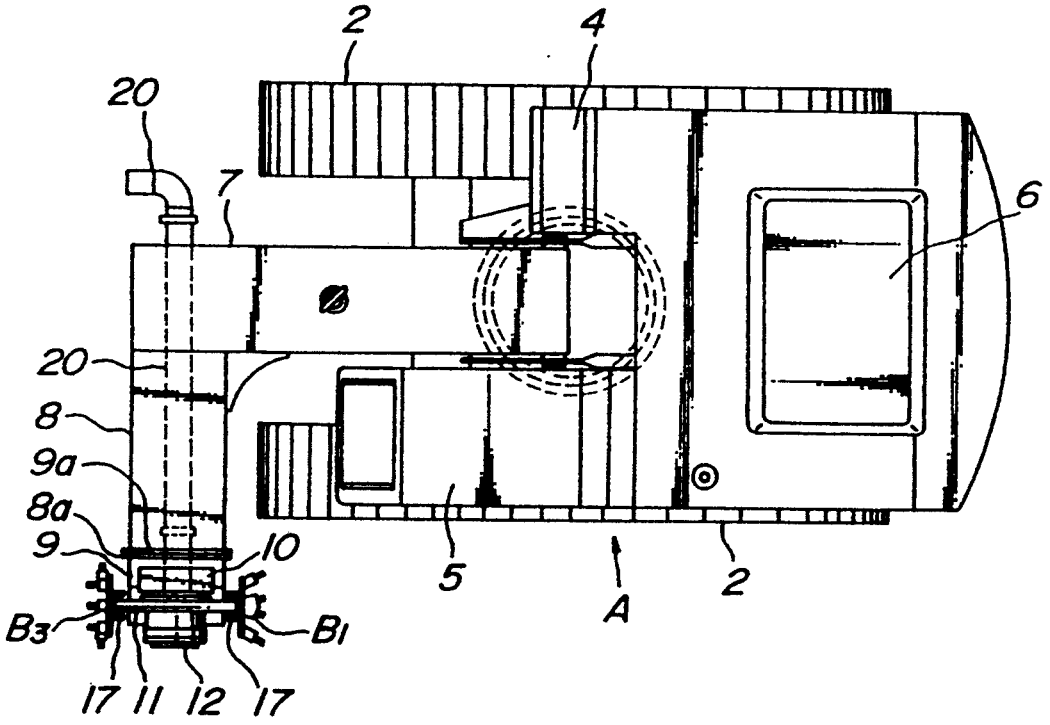
FIG. 3 is a plan view of the excavator shown in FIG. 1.
Figure 4:
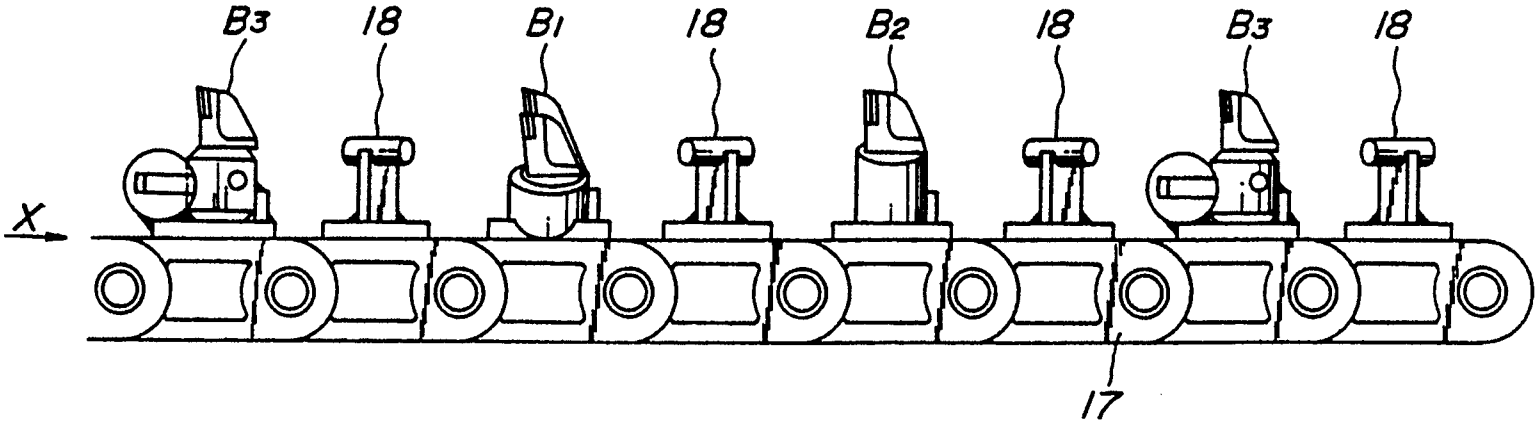
FIG. 4 is a partial side view illustrating an endless chain cutter including cutter bits and agitator bars alternately arranged on an endless chain according to the invention.
Figure 5:
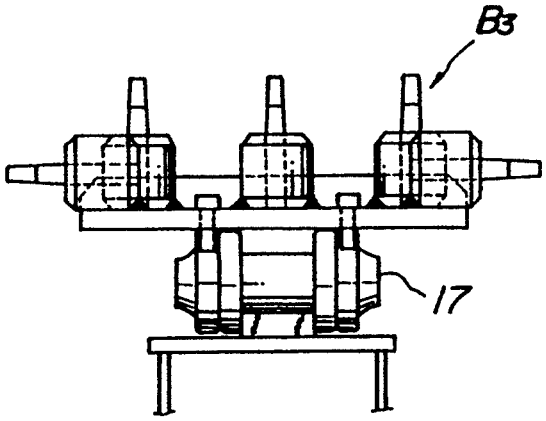
FIG. 5 is a side view of the endless chain cutter viewed in the direction X in FIG. 4.
Figure 6A:
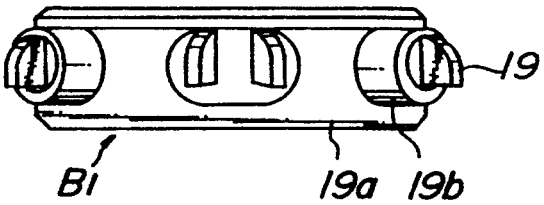
FIGS. 6*a*, 6*b* and 6*c* are plan, front and side views of one example of cutter bits used in the endless chain cutter according to the invention, respectively.
Figure 6B:
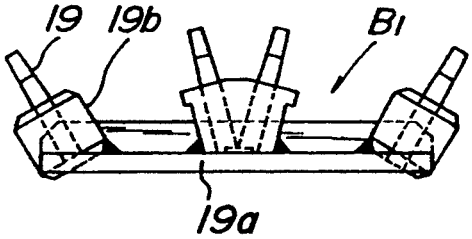
Figure 6C:
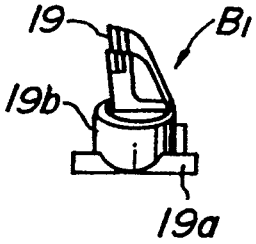
Figure 7A:
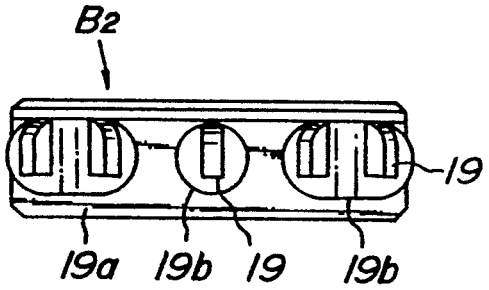
FIGS. 7*a*, 7*b* and 7*c* are plan, front and side views of another example of cutter bits used in the endless chain cutter according to the invention, respectively.
Figure 7B:
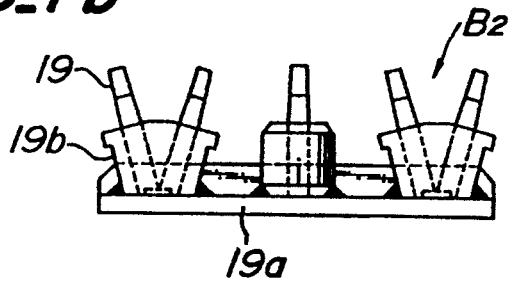
Figure 7C:
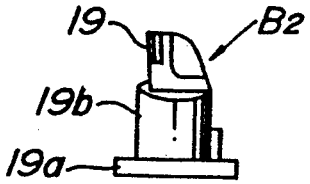
Figure 8A:
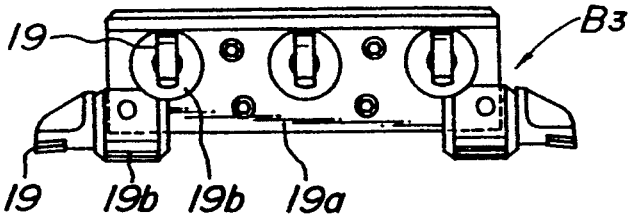
FIGS. 8*a*, 8*b* and 8*c* are plan, front and side views of a further example of cutter bits used in the endless chain cutter according to the invention, respectively.
Figure 8B:
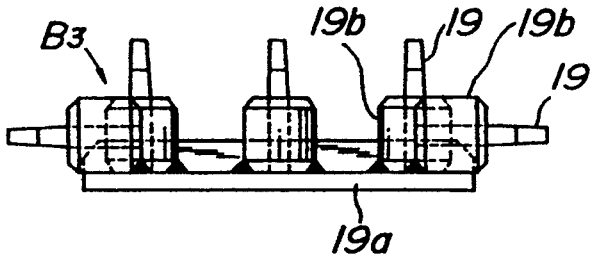
Figure 8C:
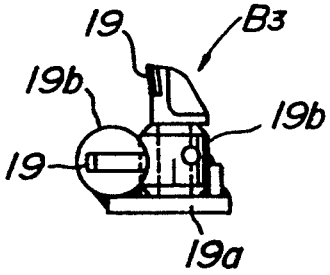
Figure 9A:
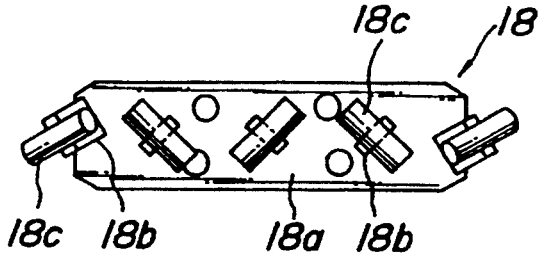
FIGS. 9*a* and 9*b* are plan and front views of one example of agitator bars used in the endless chain cutter according to the invention, respectively.
Figure 9B:
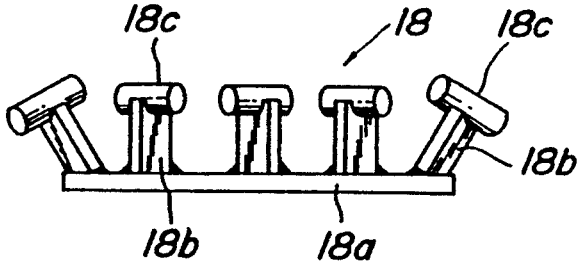

FIGS. 1, 2 and 3 illustrate the excavator of the first embodiment according to the invention. In the drawings, reference numeral 1 denotes ground to be formed therein with an underground continuous wall. A crawler type vehicle A traveling on the ground 1 includes crawlers or endless tracks 2, a turn table 3, a swivel base 4, an operator's cabin 5 and an engine compartment 6. In the illustrated embodiment, extending forward from the swivel base 4 is a boom 7 having a rectangular cross-section which is integrally formed at its front end with a boom 8 extending at 90 degrees relative to the boom 7 in the left direction viewed from the operator's cabin 5. The end of the boom 8 remote from the boom 7 extends slightly outwardly beyond from the one side (the left side in the illustrated embodiment of FIGS. 1–3) of the vehicle A.

A guide post 9 for an endless chain consists of long cylindrical members having rectangular cross-sections and is extensible by joining spare members to the guide post 9. A driving wheel 11 for driving a chain is supported by a bracket 10 provided on the top of the guide post 9 and adapted to be driven by a hydraulic motor 12. A chain sprocket 14 is rotatably supported by a bracket 13 mounted on the bottom of the guide post 9. The bracket 13 is supported resiliently relative to the guide post 9 by means of connecting members 15 (FIG. 1) with the aid of coil springs 16. An endless chain 17 extends around the chain sprocket 14 and the driving wheel 11, while a number of cutter bits B1, B2, B3, . . . and a number of agitator bars 18 are alternately secured to the endless chain 17 to form an endless chain cutter C.

FIGS. 4 to 9 illustrate these cutter bits B and agitator bars 18 in detail. With each of the cutter bits B attached to one link of the endless chain 17, bits 19 are fixed in a plane perpendicular to the advancing direction of the chain 17 to a base plate 19*a* so as not to be aligned with the bits 19 of the adjacent cutter bits B. A bit holder 19b holds one or two bits 19 and fixed to the base plate 19*a* by welding. Three different arrangements of the cutter bits are shown in FIGS. 6*a*–6*c*, 7*a*–7*c* and 8*a*–8*c*, respectively. As shown in FIGS. 9*a* and 9*b*, each of the agitator bars 18 includes a base plate 18*a* attached to one link of the endless chain 17, plural arms 18*b* attached to the base plate 18*a* by welding so as to project from the base plate and bar members 18*c* fixed to free ends of the arms 18*b*, respectively.

A jet pipe 20 is provided in the guide post 9 so as to be connected to a fluid supply source (not shown) externally provided such as supply means for hardening liquid as cement milk, highly pressurized water or air, or a stabilizer as lime or cement. The jet pipe 20 has a number of nozzles 21 branched therefrom and disc-shaped lids 20*a* (FIGS. 1 and 2) provided at the bottom end. The upper portion 9*a* of the guide post 9 is detachably fixed to the free end 8*a* of the boom 8 by means of bolts and nuts (not shown). A swivel locking device 22 (FIG. 1) is provided between the under surface of the boom 7 and a bracket 23 extending from the vehicle body for locking the swivel base 4 swiveled to a desired position.

Figure 10:
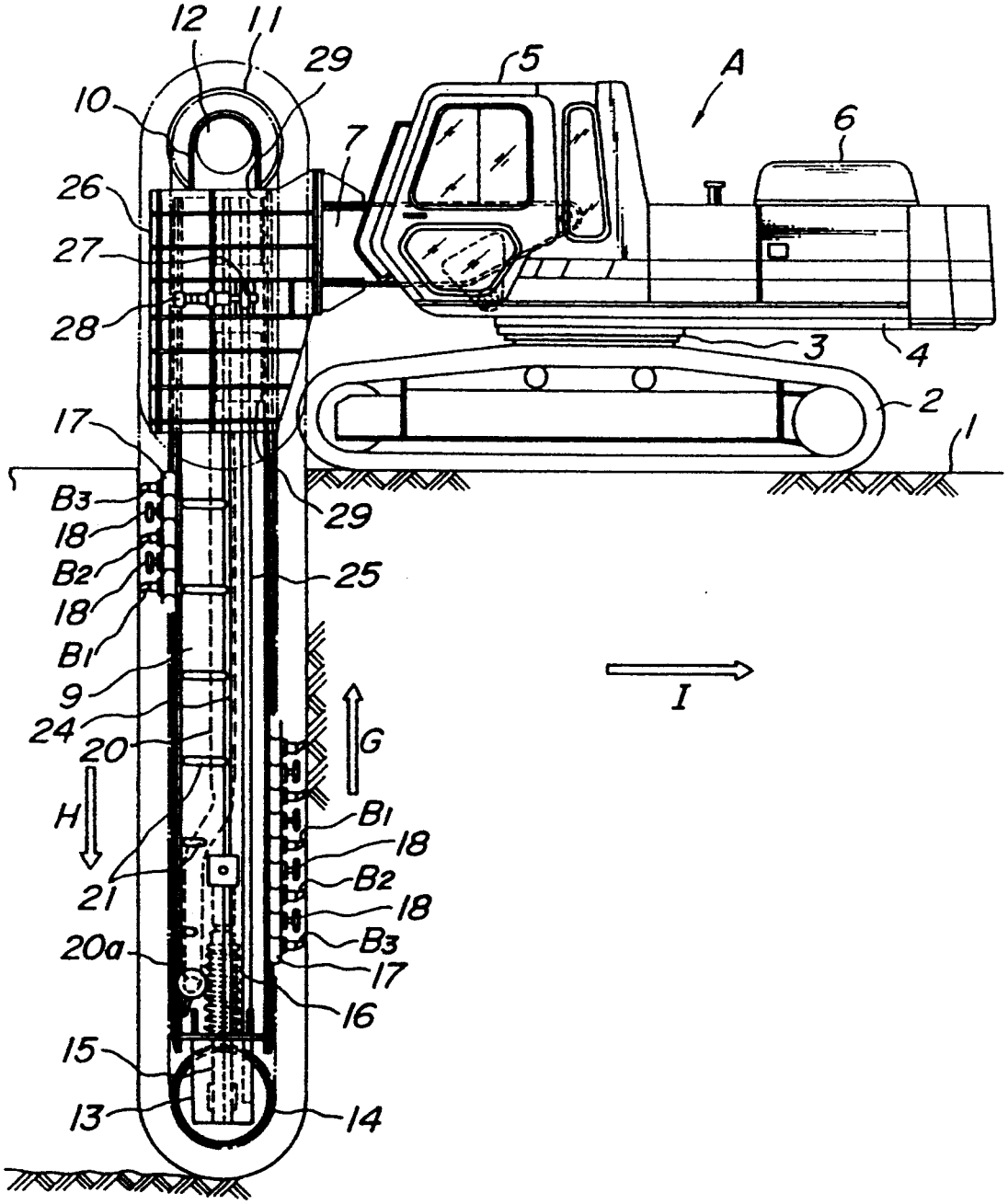
FIG. 10 is a side view of the excavator of the second embodiment according to the invention.
Figure 11:
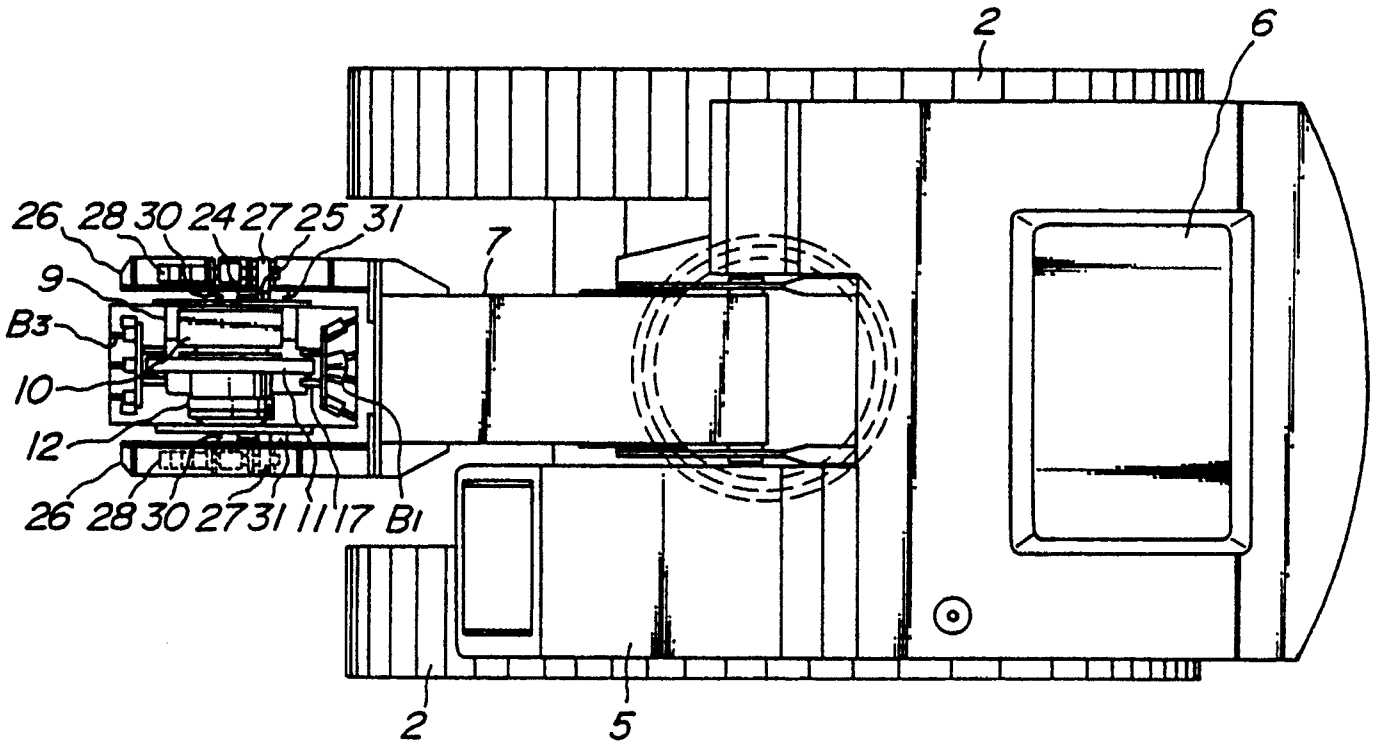
FIG. 11 is a plan view of the excavator shown in FIG. 10.

FIGS. 10 and 11 illustrate the excavator of the second embodiment according to the invention wherein like components are designated by the same reference numerals as those in the preceding drawings. The excavator is substantially similar to that shown in FIGS. 1 to 3 with exception that the endless chain cutter C is vertically movable, while the excavator of the first embodiment has the endless chain cutter C fixed to the end of the boom 8. The feature of the excavator of the second embodiment different from that of the first embodiment will be explained hereinafter.

In the second embodiment, the guide post 9 is provided with guide rails 24 along its length on both the sides thereof. Racks 25 are provided along and in parallel with the guide rails 24, respectively. A vehicle A traveling on the ground is provided with a forward extending boom 7 whose end is further provided with supporting plates 26 for vertically movably supporting the endless chain cutter C on both its sides. A pinion 27 which is engaged with the rack 25 and a hydraulic motor 28 for driving the pinion 27 are provided on each of the supporting plates 26. A lift guide block 29 shown as a square portion in broken lines in FIG. 10 is fixed onto insides of each supporting plate 26, and has guide members 30 and 31 extended therefrom so as to be slidably engaged with the guide rail 24.

In constructing underground continuous walls by the use of the excavator of the first embodiment, first a vertical hole having a predetermined depth is dug in the ground at a position where the underground continuous wall is to be formed. After the endless chain cutter C having a desired length has been assembled in the hole, the chain cutter C is fixed to the boom 8 extending from the vehicle A. While the chain cutter C is driven in the directions shown by arrows D and E in FIG. 1, the vehicle A is driven in the direction shown by an arrow F to excavate along one side of the underground continuous wall to be constructed.

Figures 12A, 12B, 12C, 12D, 12E:
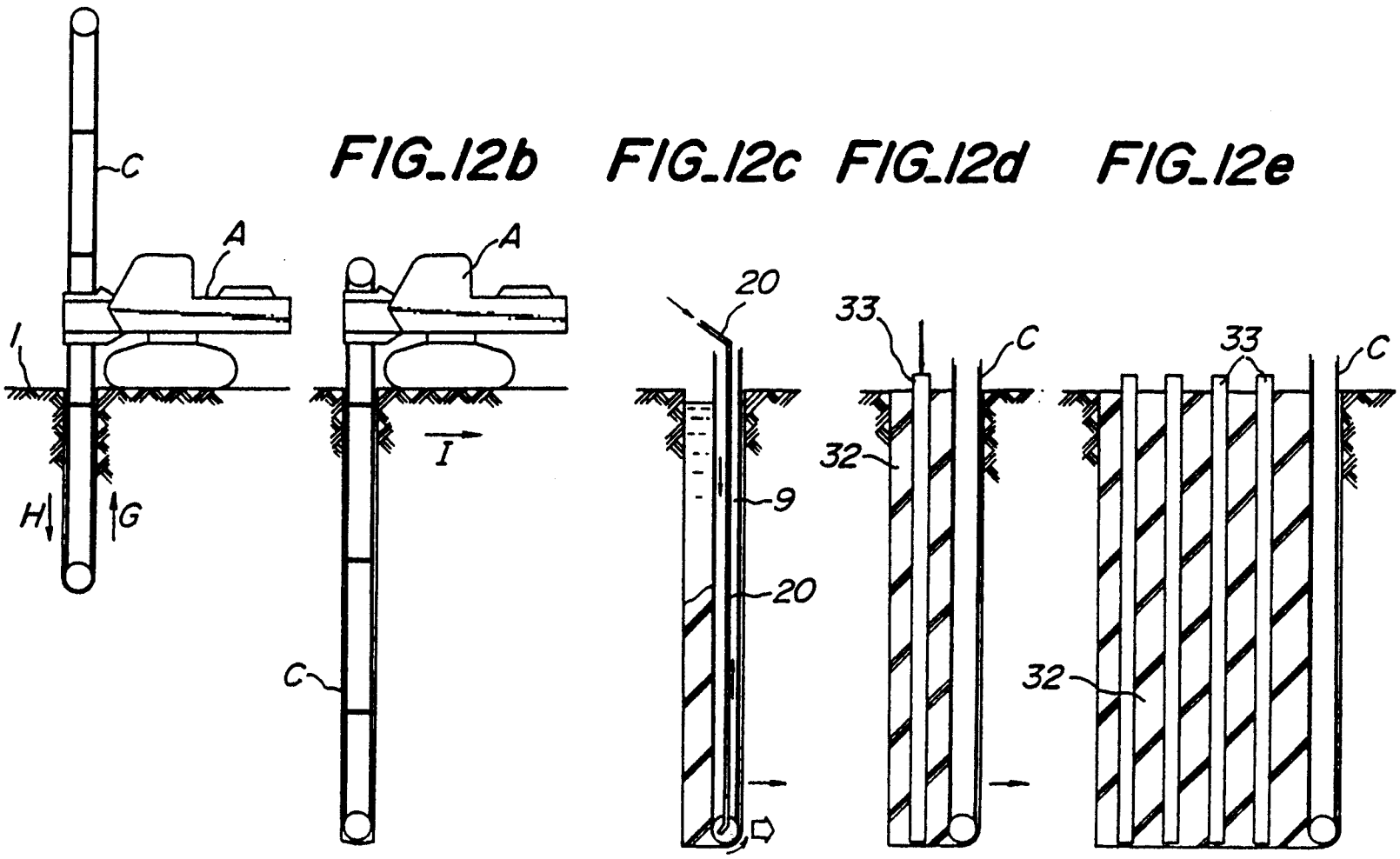
FIGS. 12*a*, 12*b*, 12*c*, 12*d* and 12*e* are views illustrating the method for constructing the underground continuous wall according to the invention for explaining the processes of the method.

In constructing the underground continuous wall by the use of the excavator of the second embodiment whose endless chain cutter C is vertically driven relative to the boom 7 extending from the vehicle C, the lower end of the endless chain cutter C is brought into contact with the ground 1 at the predetermined position and the endless chain 17 is then driven in the directions shown by arrows G and H in FIGS. 10 and 12, while the pinion 27 in mesh with the rack 25 is driven to drive the endless chain cutter C to a desired depth as shown in FIG. 12*b*.

Thereafter, the vehicle A is driven in the direction shown by an arrow I in FIG. 12*b* to excavate the ground 1, while a hardening liquid as a cement milk is jetted through the jet pipe 20 provided in the guide post 9 of the cutter C as shown in FIG. 12*c*. As a result, the hardening liquid is mixed with earth and sand in the just excavated hole to form soil cement walls 32 shown in FIGS. 12*d* and 12*e* to construct the underground continuous wall. Reference numeral 33 illustrates H-beams inserted in the soil cement wall 32 with suitable intervals by hanging the H-beams before the soil cement wall 32 has hardened.

Figure 13A:
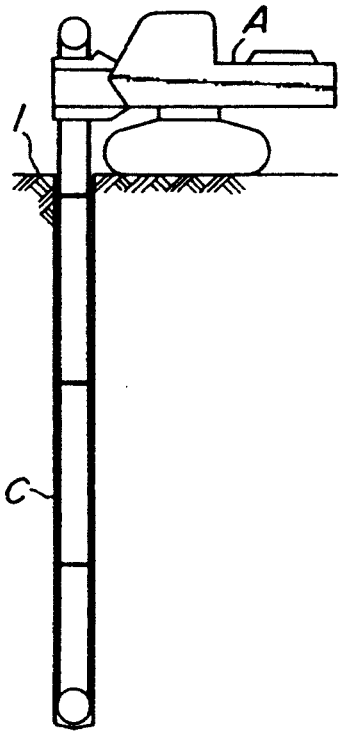
FIGS. 13*a*, 13*b*, 13*c*, 13*d*, 13*e* and 13*f* are views illustrating the ground improving method according to the invention for explaining the processes of the method, FIGS. 13*b*, 13*d* and 13*f* being plan views of FIGS. 13*a*, 13*c* and 13*e*, respectively.
Figure 13C:
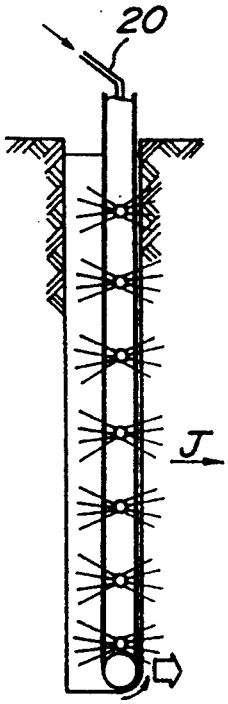
Figure 13E:
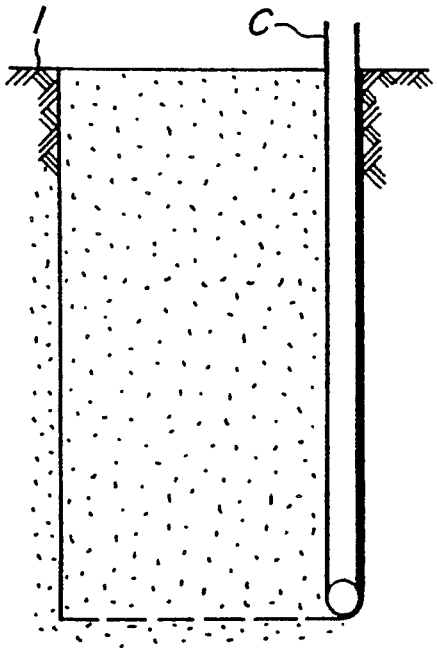
Figure 13B:
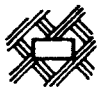
Figure 13D:
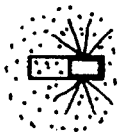
Figure 13F:
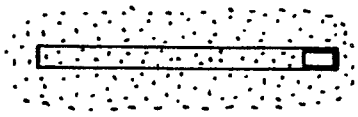

In improving the ground by the use of the excavator having the endless chain cutter C described above, first the endless chain cutter C is inserted into the ground as shown in FIGS. 13*a* and 13*b*. The ground 1 is then excavated by driving the cutter C in the direction shown by an arrow J, while pressurized water or air is jetted at the excavated place through the jet pipe 20 to destroy the stratum as shown in FIGS. 13*c* and 13*d* and at the same time a stabilizer such as lime or cement is added thereto to stabilize the ground therearound as shown in FIGS. 13*e* and 3*f*.

Figure 14A:
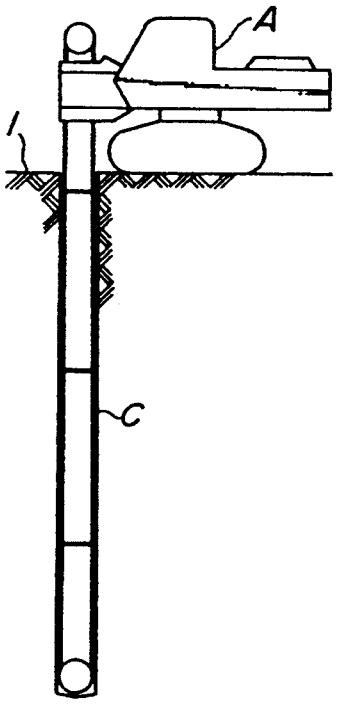
FIGS. 14*a*, 14*b*, 14*c*, 14*d*, 14*e*, 14*f*, 14*g* and 14*h* are views illustrating the wall pile constructing method according to the invention for explaining the processes of the method, FIGS. 14*b*, 14*d*, 14*f* and 14*h* being plan views of FIGS. 14*a*, 14*c*, 14*e* and 14*g*, respectively.
Figure 14C:
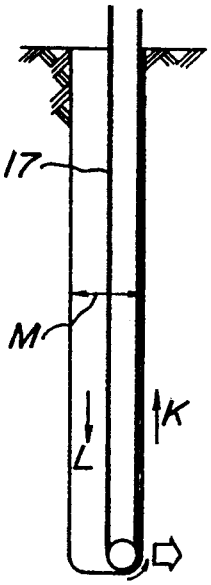
Figure 14E:
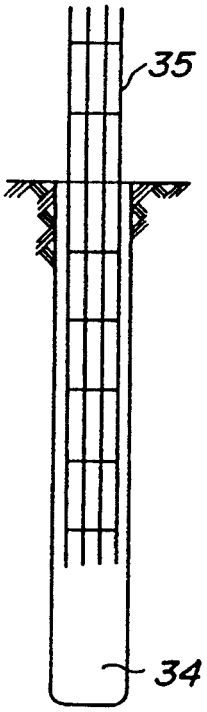
Figure 14G:
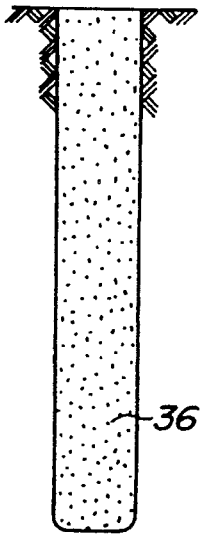
Figure 14B:
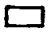
Figure 14D:
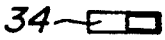
Figure 14F:
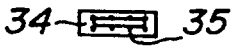
Figure 14H:
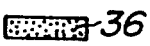

In producing a wall pile in the ground by the use of the excavator having the endless chain cutter C, first the cutter C is inserted into the ground to a predetermined depth as shown in FIGS. 14*a* and 14*b* and the cutter C is then moved through a desired distance M, while the chain 17 is being driven in the directions shown by arrows K and L as shown in FIGS. 14*c* and 14*d* to excavate a hole 34 having a rectangular cross-section seen in a plan view. After reinforcing steel 35 are inserted into the hole 34 as shown in FIGS. 14*e* and 14*f*, concrete 36 is placed to form a wall pile (FIGS. 14*g* and 14*h*).

In removing obstacles such as rocks and concrete blocks in the ground by means of the excavator having the endless chain cutter C, cemented carbide tips (for example, TR 25 available from Toshiba Tungalloy Co. Ltd.) are used for blades of the cutter bits B arranged on the chain 17 of the cutter C. The chain 17 having the cemented carbide cutter tips is driven, while the endless chain cutter is moved to cut and remove the obstacles in the ground.

The functions and effects of the excavator and the construction methods using the excavator according to the invention will be explained hereinafter. As both the excavators according to the first and second embodiments are applied to the vehicles A such as crawler type vehicles moving on the ground, it is possible to use the excavators at any place with ease for rapidly executing the operation.

Moreover, as the excavator of the second embodiment of the invention enables the endless chain cutter C to move upward and downward relative to the boom 7 extending from the vehicle A, the cutter C can be set at a desired depth by driving the chain of the cutter C to force it into the ground. Therefore, the excavator according to the invention needs no boring machine such as earth drill which is required in the prior art.

In both the excavators according to the first and second embodiments, the endless chain 17 extends around the chain sprocket 14 pivotally supported at the lower end of the guide post 9 and the drive wheel 11 provided at the upper end of the guide post 9, and a number of cutter bits B1, B2, B3, . . . and a number of agitator bars 18 are alternately arranged on the chain 17 to form the endless chain cutter C. The endless chain 17 of the cutter C is adapted to be driven and the vehicle A is made movable so that high accuracy underground continuous walls can be built with high efficiency.

The underground continuous wall constructing method using the excavator of the second embodiment of the invention needs no extra boring machine digging a hole to a predetermined depth as in the prior art method. According to the method of the invention, moreover, the ground is continuously excavated by the excavator, while the underground continuous wall can be continuously built by soil cement or cement mortar in the space immediately after being excavated. As the underground continuous wall formed by the method according to the invention has smooth surfaces without any joints or steps, there is no risk of ground water leaking through the wall surfaces. Therefore, the method according to the invention can form the continuous wall in the ground and at the same time enables the formed continuous wall to be used as a wall foundation.

Further, the ground improving method according to the invention is capable of continuously excavating the ground by the use of the excavator described above and at the same time stabilizing strata thereat. Therefore, the method of the invention can always obtain uniformly stabilized ground. As the method needs no additional equipment, the stabilizing operation is executed with low cost and with high efficiency.

Moreover, the wall pile constructing method according to the invention can easily build wall piles by using the excavator for constructing the underground continuous wall without using clam buckets. Therefore, the forming operation can be executed with high efficiency without any danger as in the prior art.

Further, the underground obstacle removing method according to the invention needs no particular crushers such as rock augers required in the prior art. All that is required is to replace usual cutter bits of the endless chain cutter of the excavator with cemented carbide tip bits. With such an excavator, underground obstacles can be cut and removed, while grooves for underground continuous walls are being excavated without requiring any particular arrangement therefor. Consequently, the operation efficiency can be greatly improved.

While the invention has been particularly shown and described with reference to preferred embodiments thereof, it will be understood by those skilled in the art that the foregoing and other changes in form and details can be made therein without departing from the scope of the invention.

What is claimed is:

1. An excavator for constructing an underground continuous wall, comprising a vehicle for traveling on the ground; a boom horizontally extending from the vehicle and having an end outwardly projecting from one side of the vehicle; an endless chain cutter including an extensible vertical guide post connected to the end of the boom, a chain driving wheel at an upper end portion of the guide post, a chain sprocket at a lower end portion of the guide post, an endless chain extending around the chain driving wheel and the chain sprocket and a plurality of cutter bits and a plurality of agitator bars alternatively arranged on the endless chain; a jet pipe in the guide post for connecting to a fluid supply source and having a plurality of nozzles branched from the jet pipe; wherein each of the agitator bars comprises a base plate attached to one link of said endless chain, plural arms attached to the base plate so as to project from the base plate, and bar members fixed to free ends of the arms, respectively.

* * * * *